US005201984A

United States Patent [19]

Bedin

[11] Patent Number: 5,201,984

[45] Date of Patent: Apr. 13, 1993

[54] DEVICE FOR THE ORIENTING OF BOTTLES APPLICABLE, IN PARTICULAR, TO BOTTLING MACHINES

[76] Inventor: Jean Bedin, Château Ysard Camblanes, 33360 Latresne, France

[21] Appl. No.: 798,625

[22] Filed: Nov. 26, 1991

[30] Foreign Application Priority Data

Nov. 30, 1990 [FR] France ..... 90 15031

[51] Int. Cl.[5] ..... B65C 9/00

[52] U.S. Cl. ..... 156/566; 156/DIG. 26; 156/DIG. 27; 156/567; 198/388; 198/394

[58] Field of Search ..... 156/567, DIG. 10, DIG. 26, 156/DIG. 27; 198/379, 382, 388, 394, 414; 414/224, 225

[56] References Cited

U.S. PATENT DOCUMENTS

| | | | |
|---|---|---|---|
| 2,707,547 | 5/1955 | Gewecke | 198/33 |
| 3,142,371 | 7/1964 | Price et al. | 198/388 X |
| 3,663,336 | 5/1972 | Alkalay et al. | 156/485 |
| 4,143,754 | 3/1979 | Eldred | 156/DIG. 26 X |
| 4,280,612 | 7/1981 | Nagaono | 198/379 |
| 4,529,469 | 7/1985 | Jorss | 156/DIG. 27 X |
| 4,628,972 | 12/1986 | LaRochelle | 198/388 X |

FOREIGN PATENT DOCUMENTS

| | | | |
|---|---|---|---|
| 2916822 | 6/1980 | Fed. Rep. of Germany . | |
| 2454969 | 4/1980 | France . | |
| 0092821 | 5/1984 | Japan | 198/308 |

*Primary Examiner*—David A. Simmons
*Assistant Examiner*—James J. Engel, Jr.
*Attorney, Agent, or Firm*—Rosenman & Colin

[57] ABSTRACT

A device for the orienting of bottles or similar containers, in particular for treatment machines such as labeling or decoration machines, each treated bottle being provided with a mark intended to come into engagement with an associated element of the orientation device, is so adapted that the associated element exerts on the bottle, as long as it is not in engagement with its mark, a push which tilts it and brings at least one point of a generatrix of its side surface to rub by contact against at least one wall during the relative displacement of the bottle and the wall.

7 Claims, 3 Drawing Sheets

DEVICE FOR THE ORIENTING OF BOTTLES APPLICABLE, IN PARTICULAR, TO BOTTLING MACHINES

BACKGROUND OF THE INVENTION

1. Field of the Invention

The present invention relates to a device for the orienting of bottles or similar containers, which is used in particular in handling machines such as labeling or decorating machines.

2. Description of Related Art

In these machines, the bottles move on a conveyor or reed line, in principle, to the entrance of a rotary indexing cross or spider where each bottle selected by the spider is placed on a saddle or cup of special trajectory which feeds the bottle carried by it to the treatment station or carousel.

It is clear that if no special measure is taken, the label or decoration is affixed to the peripheral surface of the bottle in a region which varies depending on the position assumed by the bottle around its axis at the time that it is placed on its support, saddle or cup.

In the case of labels which must be affixed at given places on the periphery of the bottle or if it is necessary to decorate it or place rosettes of wax or imitation wax of synthetic material on it, it is necessary to provide means for orienting the bottles and such means then comprise orientation marks which may consist of an excess thickness on the body of the bottles, in general located between 35 and 40 mm from the bottom of the bottles on the body of the bottles and not protruding, in which case they have a hollow or a double hollow, or under the bottom of the bottles, whether "debouching" or "not debouching".

In general, the orientation is brought about either in the entrance cross of the machines or on the treatment carousels.

However, in the entrance crosses of machines, only reference marks which are on the body of the bottles are of reliable use.

In the case of marks which are under the bottles, the bottles are oriented on the saddles of the machines by an automatic orientation system on each saddle, which results in complicated mechanisms and entails the risk, particularly in the case of labeling, of the saddles being wetted, hence definite drawbacks upon the breaking, for instance, of a full bottle (the liquid passing, at that time, into the mechanism of the saddles and causing serious interruptions in operation).

These complicated mechanisms are intended, in fact, to drive the bottles in rotation around their axis in order to bring their orientation mark into engagement with an associated element on the part in which the orientation is to be brought about.

In order to avoid these mechanical means for the driving in rotation of the bottles, there has already been proposed, in particular in Federal Republic of Germany 2916822 (Kronseder) or French application 2454969 (Otto Sick), an orientation device which is adapted to bring at least one point of a generatrix of the side surface of the bottle to rub by contact with at least one wall during the relative displacement of said bottle and said wall.

However, in these known devices, during their entire rotation around their axis, the bottles remain placed vertically on the rotary table of the indexing cross, being clamped between the wall of the compartments of said cross and the rubbing wall, which results in extensive wear of the latter and difficult adjustment of the position and shape of said wall.

SUMMARY OF THE INVENTION

In order to avoid these drawbacks, the invention provides for tilting the bottles so as to cause the contact of at least one point of their side surface against the rubbing wall and, more precisely, it is the element associated with the device which, by relative displacement with respect to the bottle, exerts on the bottle, as long as it is not in engagement with its mark, a push which tilts the said bottle and causes it to rub against said wall.

The invention applies, in particular, to the case in which the orientation is brought about in the crosses or entrance devices of the machines and it relates to bottles the orientation mark of which is a debouching or non-debouching notch provided on the bottom of the bottles.

This is furthermore, it would seem, the system most in demand at the present time and represents the trend of bottle manufacturers since the mark in question or crientation notch on the bottom of the bottles is much less visible and therefore more aesthetic than the protruding or "protruding hollow" marks, which furthermore can break easily upon impact or result in fragility of the bottles, or make it necessary to increase their weight.

The indexing element associated with each compartment of the entrance cross can be a part such as a latch of such shape that it can engage in the notch of the bottle, the part being mounted in such a manner that it can be brought in abutment against the bottom of the bottle, thus causing the tilting of the bottle towards the outside of the entrance cross and the rubbing of a small zone of its base on its feed conveyor or, preferably, the rubbing of a small region of its side wall against stationary rubbing elements arranged coaxially to said entrance cross.

These rubbing elements advantageously consist of a sequence of small semicircular elements, possibly moved back elastically, which make it possible to treat each bottle independently of the preceding bottle and the following bottle, thus avoiding malfunctioning or interference.

It is advantageous, if the notch of the bottle is a debouching notch, to provide the saddles on which the bottles come to rest with a small spur intended to engage in the portion of the notch left free by the latch of the entrance cross, the notch then being indexed with respect to the saddle and assuring greater precision and better maintaining of orientation of the bottle when the latter escapes the said latch.

In certain cases it may be useful to mount the element associated with the entrance cross in axially moveable manner by fastening it, for instance, to a roller which rolls on a cam provided above the cross.

BRIEF DESCRIPTION OF THE DRAWINGS

The invention will be better understood from an example of a machine equipped in accordance with the invention in which the orienting of the bottles is effected in the entrance cross and in which the bottles are provided with a debouching notch, the description being given with reference to the accompanying diagrammatic drawings in which.

DETAILED DESCRIPTION OF THE PREFERRED EMBODIMENT

Figure 1:
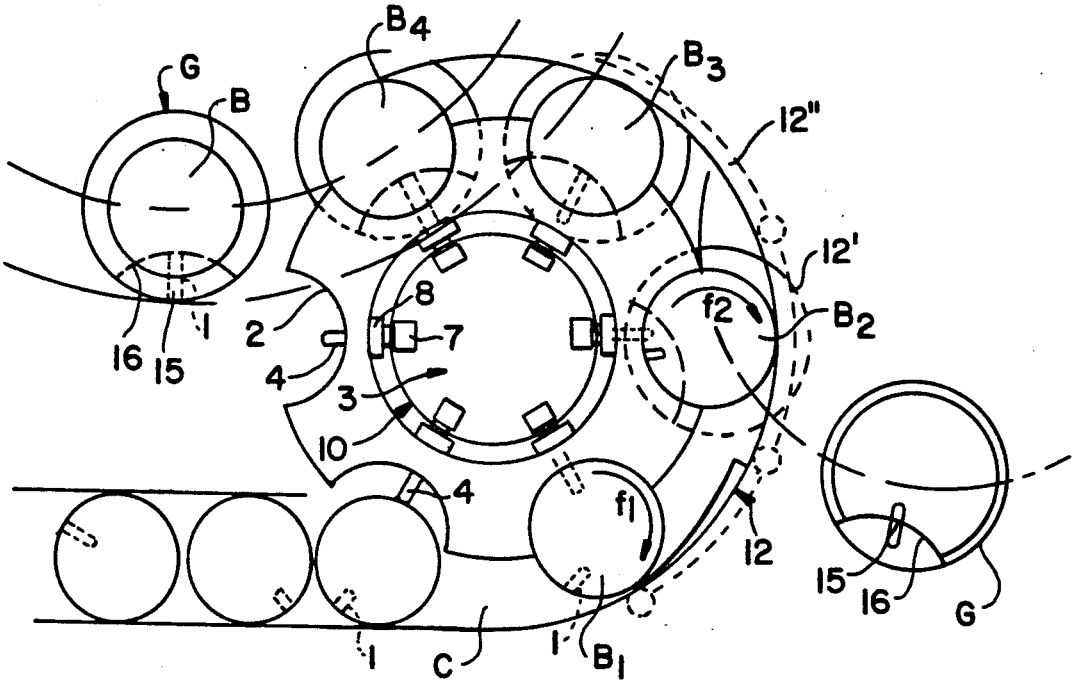
FIG. 1 is a top view of the zone of entrance of the bottles into the machine.
Figure 6:
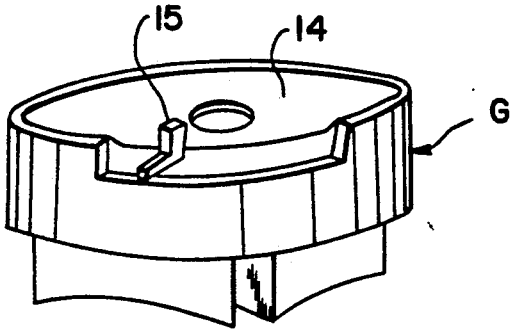
FIG. 6 is a perspective view of a saddle or cup, constituting the bottle support.

In the embodiment shown, the bottles B are provided on their base with a debouching notch 1 and, with each compartment 2 of the entrance cross 3, there is associated a latch 4 mounted at the end of an arm 5, which in its turn is borne by a shaft 6 and rod 11 which are parallel to the axis of the cross 3 and mounted for sliding in the cross. The head or upper end 7 of the shaft 6 bears a roller 8 which turns on a shaft 9 which is firmly secured to the head 7. Above the cross 3 there is mounted, fixed in position, a circular ramp 10 which is coaxial to the cross 3 and on which the rollers 8 can roll.

In a stationary frame H, extending concentrically to the cross 3, there are housed successive rubbing sectors 12, 12', 12" which are retracted elastically by springs 13.

Figure 2:
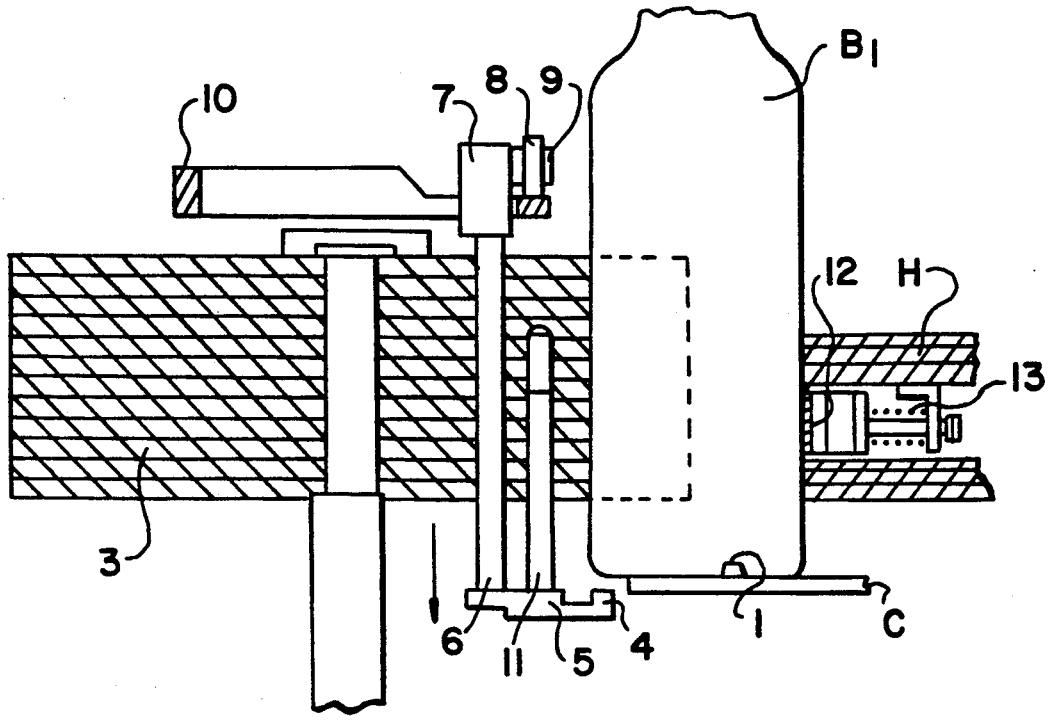
FIGS. 2-5 are sectional views through the axis of the selection spider or entrance cross of FIG. 1, but on a larger scale, corresponding to four successive positions of the bottle on said spider.
Figure 3:
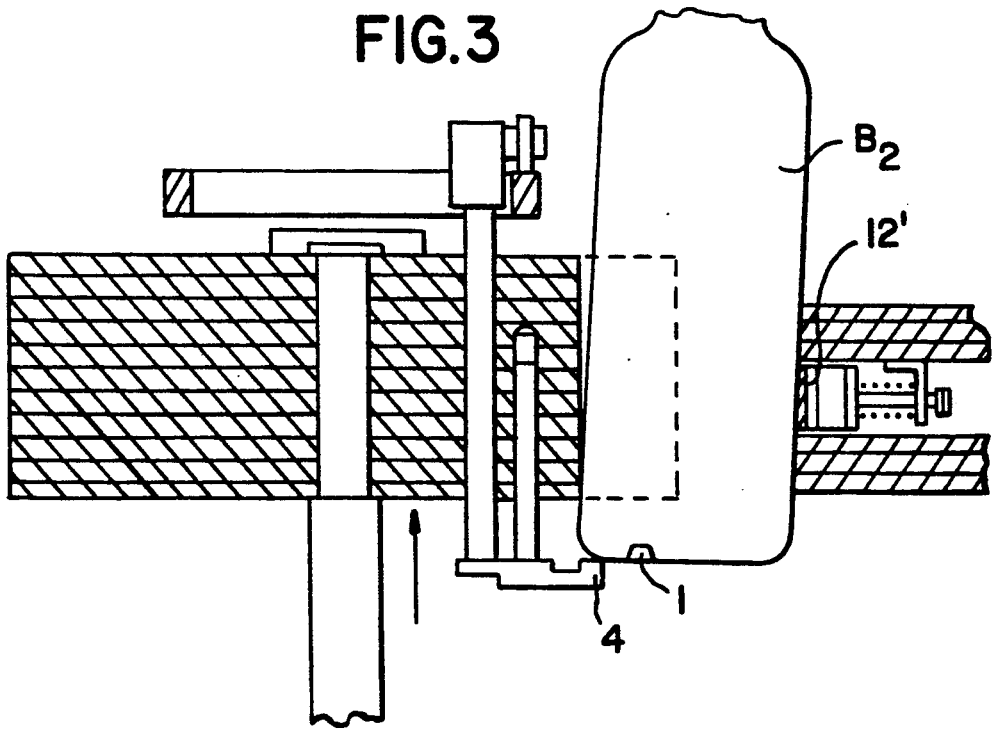
Figure 4:
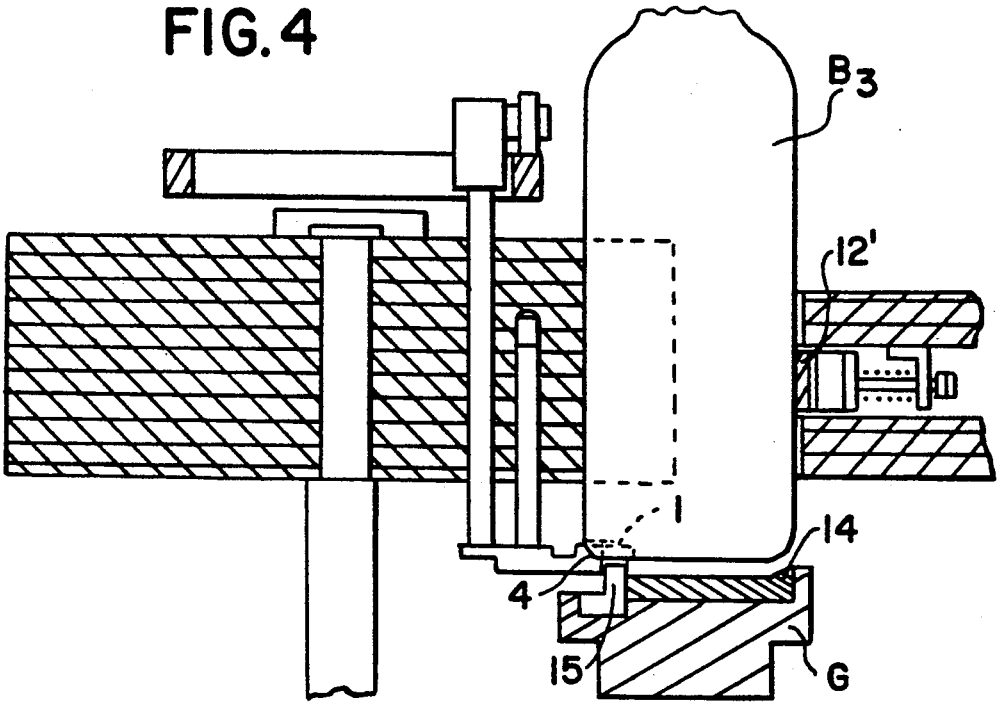

As can be noted from FIG. 1, the bottles B arrive on the conveyor or chain C and are selected by the cross 3. With the bottle occupying the position $B_1$ (FIGS. 1 & 2), the latch 4 is below the bottom of the bottle and the bottle still rests on the conveyor C. As the cross 3 continues its rotation, the ramp 10 causes the upward displacement of the roller 8 and therefore of the latch 4, which lifts the bottle slightly while tilting it (FIG. 3). On its path from position $B_1$ to $B_2$ and then $B_3$, the bottle supported by the latch 4 and rubbing with its side wall against the brake sectors 12, 12', 12" is automatically imparted, via its notch, a movement of rotation around its axis, as indicated by the arrows $f_1$, $f_2$ (FIG. 1). This rotation continues up to position $B_3$ in which the latch 4 is opposite the notch 1 and penetrates therein (FIG. 4). The bottle is straightened and is then oriented and its drive in rotation ceases since it is no longer in contact with the brakes.

Figure 5:
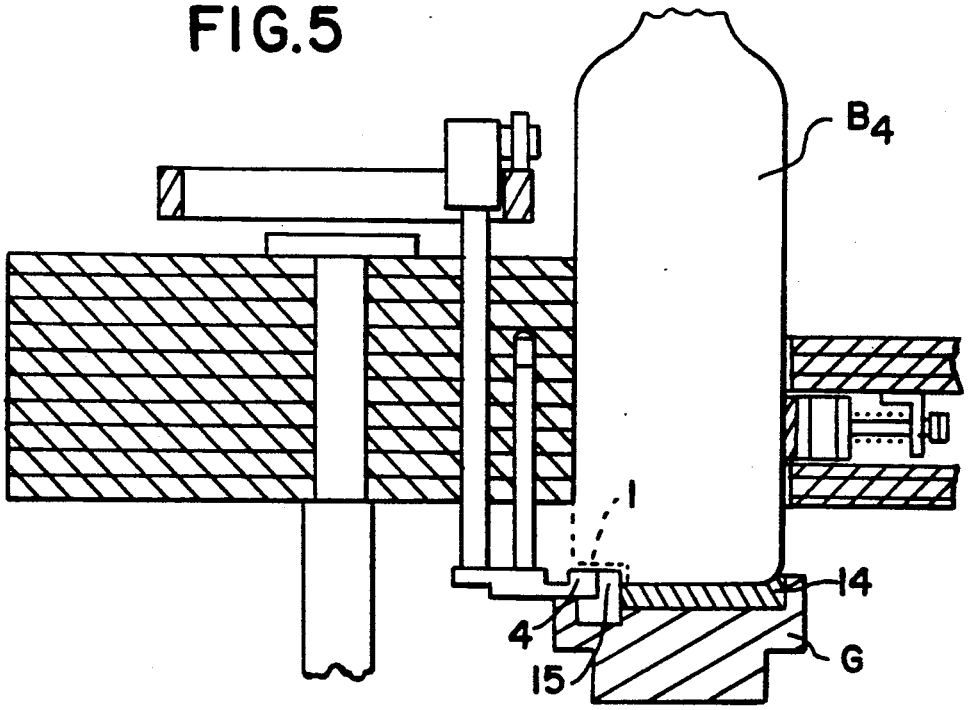

At the same time as the bottles, the saddles or cups G have been fed in known manner in order to come below the path of the bottles and permit the latter to deposit there (FIGS. 1 & 5).

The cups G, provided with an interchangeable mold 14, have each been provided with a latch or mark 15 which places itself within the part of the notch 1 which has been left free by the latch 4. The notch 1 is thus indexed with respect to the cup, which assures better precision in the orientation of the bottle.

The bottle and its cup then escape the latch of the entrance cross due to the semicircular recess 16 provided in each of the cups.

I claim:

1. An arrangement for orienting bottles to a predetermined angular position, each bottle having a bottle axis, a bottle side wall, a bottle bottom wall and a bottle mark, said arrangement comprising:
   (a) a rotary selector wheel having a plurality of compartments rotatable about a wheel axis;
   (b) means for successively conveying the bottles into the compartments;
   (c) means for turning each bottle about its respective bottle axis until the bottle mark is positioned at said predetermined angular position;
   (d) tilting means for tilting each bottle in its respective compartment during turning to said predetermined angular position to a tilted position in which the respective bottle axis is inclined relative to the wheel axis at an angle other than a right angle; and
   (e) said turning means including braking means for engaging a reduced braking zone on a respective bottle side wall in the tilted position of the respective bottle.

2. The arrangement according to claim 1, wherein the braking means includes a set of brake pads having a braking surface concentric with the wheel axis.

3. The arrangement according to claim 2, wherein the braking means includes means for resiliently uring the brake pads against the respective reduced braking zone of the respective bottle.

4. The arrangement according to claim 1, wherein the bottle mark is a peripheral recess formed in the bottle bottom wall, and wherein the tilting means includes an indexing element mounted on the wheel below a respective bottom wall and received in a portion of the recess at said predetermined angular position.

5. The arrangement according to claim 4, wherein the tilting means includes means for raising the indexing element into engagement with one side of the respective bottom wall.

6. The arrangement according to claim 5, wherein the raising means includes an elongated drive shaft extending along a shaft axis parallel to the wheel axis, said drive shaft having one end connected to the indexing element, and an opposite head end on which a roller is mounted; and also including an annular ramp concentric with the wheel axis and on which the roller rolls, said ramp having an elevated ramp portion in the tilted position of the respective bottle.

7. The arrangement according to claim 4; and further comprising means for successively conveying bottle supports to the wheel at said predetermined angular position, each support having a base for supporting a respective bottle, and an alignment projection received in another portion of the respective recess.

* * * * *